US009187295B2

(12) United States Patent
Schneider et al.

(10) Patent No.: US 9,187,295 B2
(45) Date of Patent: Nov. 17, 2015

(54) SAFETY AND CONTROL METHOD FOR CRANES

(75) Inventors: Klaus Schneider, Hergatz (DE); Martin Rajek, Bludesch (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 1297 days.

(21) Appl. No.: 11/897,920

(22) Filed: Aug. 31, 2007

(65) Prior Publication Data

US 2008/0053945 A1 Mar. 6, 2008

(30) Foreign Application Priority Data

Aug. 31, 2006 (DE) ..... 10 2006 040 782

(51) Int. Cl.
*B66C 13/16* (2006.01)
*B66C 15/04* (2006.01)
*B66C 15/06* (2006.01)

(52) U.S. Cl.
CPC ..... *B66C 15/045* (2013.01); *B66C 15/065* (2013.01)

(58) Field of Classification Search
USPC ..... 212/276, 280, 281
See application file for complete search history.

(56) References Cited

U.S. PATENT DOCUMENTS

| | | | | |
|---|---|---|---|---|
| 2,346,066 | A * | 4/1944 | Conrad | 340/685 |
| 5,179,525 | A * | 1/1993 | Griffis et al. | 703/1 |
| 5,272,939 | A * | 12/1993 | Markyvech et al. | 477/120 |
| 6,225,574 | B1 * | 5/2001 | Chang et al. | 177/139 |
| 2004/0055986 | A1 * | 3/2004 | Lamb | 212/276 |
| 2007/0050115 | A1 * | 3/2007 | Discenzo et al. | 701/50 |

FOREIGN PATENT DOCUMENTS

| | | | |
|---|---|---|---|
| DE | 1906599 | | 10/1969 |
| DE | 24 41 785 | A * | 3/1976 |
| DE | 2441785 | | 3/1976 |
| DE | 216222 | | 12/1984 |
| EP | 0252841 | A1 | 1/1988 |
| EP | 0614845 | | 9/1994 |
| FR | 2464914 | | 3/1981 |
| FR | 2638440 | A1 | 5/1990 |
| FR | 2680897 | | 3/1993 |
| JP | 08-188379 | A * | 7/1996 |
| JP | 2003118981 | | 4/2003 |
| JP | 2005-29338 | A * | 2/2005 |
| SU | 449879 | * | 6/1975 |

OTHER PUBLICATIONS

Examination Report of DE 10 2006 040 782.2-22, German Patent and Trademark Office, Oct. 28, 2010, 3 pages.
ISA EPO; International Search Report of EP07014608; Mar. 18, 2009; WIPO.

* cited by examiner

*Primary Examiner* — Emmanuel M Marcelo
(74) *Attorney, Agent, or Firm* — Alleman Hall McCoy Russell & Tuttle LLP

(57) ABSTRACT

The disclosure includes a safety method for the lifting and/or transporting of a common load using a plurality of cranes, comprising the steps: determining of possible damage incidents for movement vectors of the cranes; activation of an alarm function if predetermined movement vectors result in damage incidents and/or limitation of the movement vectors used for the control of the cranes to those movement vectors which do not result in damage incidents in any of the cranes. Furthermore, a corresponding control method as well as a safety system and a control system are provided.

21 Claims, 6 Drawing Sheets

SAFETY AND CONTROL METHOD FOR CRANES

CROSS REFERENCE TO RELATED APPLICATION

This application claims priority to German Utility Model Application No. 10 2006 040 782.2, filed Aug. 31, 2006, which is hereby incorporated by reference in its entirety for all purposes.

BACKGROUND

The present application relates to a safety and control method for the lifting and/or transporting of a common load using a plurality of cranes. Up to now, such a lifting or transport process for large, heavy or complex loads, in which a plurality of cranes have to be used, has usually been carried out through a supervisor. In this process, each of the cranes involved is controlled by a crane operator, with the supervisor coordinating all the involved crane operators. This naturally produces a number of error potential factors, not least also because the individual crane operators do not have an overview of the total situation and because problems of understanding and communication can lead to errors. Such a process is also not very effective since the required coordination through the supervisor only allows very slow working.

Independently of the problems due to misunderstandings, however, the further problem is also produced that the safety systems of the individual cranes are not sufficient for such a common lift or transport of a load. This is primarily due to the fact that damage incidents at a crane such as an overload or a collision can be caused not only by the movement of the crane itself, but also by the movement of the other cranes. The known overload safety devices of the individual cranes, which only prevent movements of each individual crane which would damage that crane, cannot also take account of damage incidents at other cranes. The situation is the same with anti-collision systems which likewise only take account of the movements of the crane itself and at best permit static disturbance objects. The movement procedures with a plurality of cranes are also much more complex than with only one crane.

SUMMARY

It is therefore the object of the present disclosure to be able to carry out the lifting and/or transporting of a common load using a plurality of cranes more safely and more effectively.

This object is satisfied in accordance with the disclosure by a safety method for the lifting and/or transporting of a common load using a plurality of cranes. This method comprises the determination of possible damage incidents for movement vectors of the cranes as well as the activation of an alarm function if predetermined movement vectors result in damage incidents and/or the limitation of the movement vectors used for the control of the cranes to those movement vectors which do not result in damage incidents in any of the cranes.

Two possibilities of controlling the cranes thus substantially result by the safety method in accordance with the present disclosure. On the one hand, the individual cranes can continue to be operated by one respective crane operator, with the movement vectors preset by the crane operators, however, being checked by the safety method of the present disclosure as to whether they result in damage incidents. If a movement vector preset by the crane operators results in a damage incident at any one of the cranes, an alarm function is activated which warns the crane operator of the impending damage incident on a performance of the movement. However, an automatic limitation of the movement vectors used for the control of the crane can also be carried out so that movements which would result in damage incidents are not performed at all.

Alternatively, the safety method in accordance with the disclosure can also be used within a control method for the cranes. Which movement vectors are available for the secure control of the cranes is thus determined automatically by the safety method by the determination in accordance with the present disclosure of possible damage incidents for the movement vectors of the cranes. The control system can select from these movement vectors the one best suited to achieve the desired movement.

A movement vector of the cranes represents a set of data which contains information on the control of all cranes. The movements of all cranes involved are therefore checked with respect to possible damage incidents of all cranes involved. It is thereby automatically ensured by the safety method in accordance with the present disclosure during running operation that the movement of an individual crane does not only not result in damage to that actual crane, but also does not result in damage at the other cranes.

The damage incidents which are determined in the safety method in accordance with the present disclosure advantageously include at least an overload of the cranes. It is thus ensured that no movements of the cranes are performed which would result in an overload of one of the cranes. Unlike the prior art, in which the individual load torque limitation devices of the cranes could in each case only determine whether a movement results in an overload at their own crane, it is ensured by the safety system in accordance with the present disclosure that, on a movement of a crane, overloads can also not occur at any other crane.

Possible overloads can advantageously be determined in this context via the load torque determination devices associated with the respective crane. It is therefore absolutely possible with the method in accordance with the present disclosure to make use of existing load torque limitation devices. However, not only the movement of an individual crane is checked by its own load torque limitation device, but the movement vector of all cranes is rather checked by the load torque limitation devices of all cranes. It is thus possible to make use of already existing technology, on the one hand, but the safety of the common lift or transport by a plurality of cranes can be secured substantially better, on the other hand. In this connection, the existing load torque limitation devices do not necessarily still have to be arranged on the individual cranes. A central processing unit is rather also feasible in which the torque limitation devices associated with the individual cranes are implemented.

The permitted movement vectors are advantageously determined by a predictive calculation in the safety method in accordance with the present disclosure. A check is thus not only made as to whether a current movement will directly result in a damage incident, but also as to whether a future damage incident could be provoked by a current movement. It is in particular advantageously taken into account that only those movement vectors are permitted in which a movement procedure is available which does not result in damage incidents. Such a predictive calculation is in particular important since situations can arise on a common lift or transport by a plurality of cranes in which all movements of the cranes would result in a damage incident on at least one of the participating cranes. Those situations out of which the total system can no longer be safely maneuvered are, in contrast, prevented by the predictive calculation of the safety method in accordance with the disclosure. Such a predictive calculation can also be of great importance for damage events other than an overload since e.g. collisions can be prevented by it in that it is taken into account that the system has to come to a standstill after every movement carried out without a collision occurring.

The permitted movement vectors are advantageously determined by an iterative process. It can hereby be determined securely and reliably whether a first movement vector permits later movement vectors which are free of damage incidents. It can thus be ensured that a damage-free movement procedure is always available. In such an iterative process, the control of the cranes with a first movement vector can first be simulated by way of calculation and a further movement with a new movement vector can be simulated from the new situation resulting therefrom, and so on, so that a chain of permitted movement vectors is produced.

Equally, however, an iterative process can already be used in the individual steps so that the safety is first checked for a first crane for the determination of permitted movement vectors, whereupon the permissibility for the vectors permitted there is checked for the next crane, and so on.

In a further advantageous manner, the possible damage incidents in the safety method in accordance with the disclosure include a collision of the cranes among one another. It can thus be ensured by the safety system in accordance with the disclosure that the plurality of cranes, which after all act in the same area, do not collide with one another. The influence of the movements of all cranes with respect to one another is in turn taken into account here so that the safety is greatly increased over known anti-collision systems in which only the movement of an individual crane can be taken into account.

In a further advantageous manner, the possible damage incidents include a collision of the cranes with the load. This ensures that the cranes do not collide with the load even on the lift or transport of complex loads by a plurality of cranes. The taking into account of the movement of all cranes in accordance with the disclosure is also necessary here since the movement of a crane can displace the load such that it collides with another crane without the latter having moved.

In an advantageous manner, the determining of the possible collisions in the safety method in accordance with the disclosure is based on at least one geometrical model of the cranes and, optionally, of the load. Such a geometrical model e.g. includes data on the cranes such as the boom length, the height, etc. and can advantageously put these crane data together with positional data such as the swing angle and the luffing angle to form a three-dimensional model of the cranes and of the load so that the actual lift situation can be realistically simulated in the geometrical model. Rigid area associations are hereby no longer necessary since the anti-collision device can react dynamically to different situations due to the geometrical model.

Advantageously, geometrical data of the load can be input and/or determined in the safety method in accordance with the present disclosure. A reliable geometrical model of the load can thus also be prepared, so that the anti-collision device of the safety method in accordance with the disclosure becomes even more reliable. In this process, the position and/or extent of the load can advantageously be determined via the positions of the load holders of the cranes.

In a further advantageous manner with the safety method in accordance with the disclosure, geometrical data of possible disturbance objects can be input and possible collisions of the cranes and/or of the load with the disturbance objects can be calculated. In this manner, realistic scenarios of the lift or transport can be prepared in which disturbance objects such as buildings can be taken into account.

The calculation of the possible collisions is advantageously based on a geometrical model of the cranes, of the load and/or of the disturbance objects. This geometrical model thus represents a scenario in three dimensions in which possible collisions of the cranes, of the load and/or of the disturbance objects are determined.

In a further advantageous manner, the possible damage incidents include events exceeding the limit of the torque sum of the cranes. In particular when the cranes are fixedly mounted to an object such as a ship or a platform, the torques of the cranes can be added such that dangerous situations arise such as overloads at the platform or an excessive heeling of the ship. Since a check is also made in the system in accordance with the disclosure as to whether movement vectors of the cranes result in exceeding the limit of the torque sum of the cranes, such problems can be avoided.

In a further advantageous manner, the possible damage incidents include exceeding the limit in external limitations such as a maximum permitted heeling of a ship, a maximum permitted ground pressure or a maximum permitted torque of a platform. These external limitations which have to be observed not only by one single crane, but by all cranes together, can thus also be securely observed by the safety method in accordance with the disclosure.

Possible damage incidents are advantageously recognized in a predictive calculation in the safety method in accordance with the disclosure, with their possible prevention being taken into account. A check is thus made in a predictive calculation in every movement vector as to whether a further movement procedure which is free of damage incidents is possible with this movement vector. Only those movements are therefore carried out in which it is has been found that the possibility of averting damage incidents is present. For example, movement procedures up to standstill can be checked through in this process in the predictive calculation.

The predictive calculations are advantageously activated in the safety method in accordance with the disclosure on the basis of the dynamic properties of the crane, in particular on the maximum possible speeds and/or accelerations of the crane drives. The taking into account of the dynamic properties of the cranes is of great importance since, naturally, only those movement procedures also actually realistically remain free of damage which can also actually be carried out by the cranes. It is important for this purpose that the movement vectors of the cranes used in the calculation only include those movement vectors which are disposed within the maximally possible speeds and/or accelerations of the crane drives. A movement vector of the cranes in this context preferably includes data on the speeds and/or accelerations of every single crane drive of all cranes so that a limitation of the movement vectors to the movement vectors also actually able to be carried out can easily be carried out. To reduce the calculation effort, a movement vector of the cranes can, however, also contain data at a higher level such as the movement and/or acceleration of the tip of the boom which first have to be translated into movements and/or accelerations of the crane drives. In this connection, however, it has to be taken into account that such higher level data such as e.g. a specific speed and acceleration of the tip of the crane boom can be possible by different movements of the crane drives so that a plurality of movement vectors at the lowest level can correspond to these higher level movement vectors.

In a further advantageous manner, the deformation of the cranes is taken into account in the safety method in accordance with the disclosure. The actual movement procedure can thus be represented more realistically in the system, which increases the safety.

The alarm function in the safety method in accordance with the disclosure advantageously includes an automatic deactivation of the cranes. It is thus automatically ensured, in particular when all the cranes are controlled by their own crane operators, that no movements can be carried out which would result in a damage incident. Alternatively, the movements can also be limited in that direction which would result in a damage incident.

In a further advantageous manner, safety distances to the possible damage incidents can be selected in the safety system in accordance with the disclosure. The safety of the system can thus be further increased in that it is ensured that the movement vectors used for the control of the cranes only result in situations which have a specific safety distance to damage incidents. In the anti-collision check, such a safety distance can be a spatial distance between the cranes themselves or between the load or disturbance objects which must not be fallen below. In the case of other damage incidents such as overloads, it is thus ensured that all the cranes are moved in one area in which they still have a specific safety distance from their respective overloads.

In a further advantageous manner in the safety method in accordance with the disclosure, data are forwarded to external systems such as the ballasting control of a ship, in particular to control such systems, and/or data are exchanged with this external system. Since the safety of a common lift or transport is frequently not only dependent on the cranes themselves, but also on external influences, such an exchange of data and a possible control by external systems can further increase the safety. In particular when the cranes are fixedly mounted on a ship, the ballasting system of the ship can be taken over by the crane control here to prevent excessive heeling. Alternatively, it is also possible for the safety system of the cranes to receive data from the ballasting control or other external systems so that, optionally, the limits for specific limitations can be adapted.

In a further advantageous manner, the cranes can be moved in the safety method in accordance with the disclosure, with them comprising means for the determining of their positions, in particular GPS devices. The safety method in accordance with the disclosure can thus be used for a plurality of cranes such as mobile cranes, crawler-mounted cranes or other movable cranes. The means for determining the position of the individual cranes then ensure that the safety system knows individual positions of the cranes and can thus reliably determine incident events.

The present disclosure further comprises a safety system for the operation of a plurality of cranes in accordance with one of the safety systems described above. Such a safety system in which the aforesaid safety systems are implemented has the same advantages as the methods described above. Such a safety system usually includes a processing unit on which the safety method is carried out automatically, in particular during the operation of the cranes, that is during the lift or transport of the common load by the plurality of cranes. Such an automated safety system has the great advantage that it checks the movements of all cranes and includes them in the calculation, with influences only occurring during the actual crane deployment also being able to be taken into account by the safety system in accordance with the disclosure.

The present disclosure is, however, not limited to a pure safety system. It can rather also be implemented in a control system for a plurality of cranes.

The present disclosure therefore also includes a control system for the lifting and/or transporting of a common load with a plurality of cranes, with input means for the presetting of a desired movement of the load or of the cranes and at least one processing unit for determining possible damage incidents for movement vectors of the cranes, with the movement vectors used for the control of the cranes being limited to those movement vectors which cannot result in damage incidents in any of the cranes. Such a control system has the same advantages as the safety systems described above, with the control system here automatically taking over the safety. The control system can thus also include all the further features of the safety systems described above.

It is still possible in this connection for all cranes to be controlled individually either by their own crane operators or in each case individually, but centrally, with the control system in accordance with the disclosure only ensuring that the individual cranes are not moved such that accident incidents could occur.

In this context, a single source is advantageously used for the presetting of the desired movement of the load or of the cranes. All the cranes can thus be controlled centrally. In this connection, the movement of the load is advantageously preset by the single source so that the crane operator can concentrate fully on the movement of the load, while the control system takes over the control of the individual cranes.

Possible movement vectors of the cranes or of the load are advantageously determined on the basis of the dynamic properties of the cranes, in particular on the maximum possible speeds and/or accelerations of the crane drives. Advantageously only those movement vectors are therefore permitted for the control which can actually also be carried out by the corresponding crane drives. This is in particular of great importance on the presetting of the desired movement of the load. It is thus ensured that the crane operator can only preset those movements which can also be carried out.

The presetting of the desired load movement advantageously includes the desired load position, the desired movement direction and/or the desired alignment of the load. As a rule, a direction, a position or a rotation of the load movement is thus input by the crane operator. The movement vector of the load, however, usually has substantially less degrees of freedom than the movement vector of the cranes since a plurality of cranes are present and they have a plurality of drives. Boundary conditions such as a specific position of the coupling points to the load and thus a specific position of the coupling points of the cranes with respect to one another must admittedly also be observed, and equally the boundary conditions predetermined by the safety system; however, a plurality of possibilities nevertheless frequently result, for example of implementing a specific movement direction of the load by movements of the cranes.

The control system in accordance with the disclosure can therefore select the movement vectors actually used for the control of the cranes from the possible and permitted movement vectors by specific strategies.

In this connection, the movement sectors used for the control of the cranes are advantageously selected by selectable, weightable and/or preset strategies. If strategies are predetermined, the crane operator can make a selection between the individual strategies in dependence on the situation or can optionally also weight said strategies among one another.

The strategies advantageously include a lowest deviation from the preset values for the desired movement. If therefore a specific movement of the cranes or of the load is preset by the crane operator, it is ensured by this strategy that that movement vector from the permitted vectors is used for the control of the crane drives which only generates a minimal deviation of the actual movement of the load and/or of the cranes from the desired one.

In a further advantageous manner, the strategies can include at least one of the following preset values: an enlarging of the safety distances from the safety system, the blocking of a mechanism or the association of priorities to individual mechanisms. If the safety distances from the safety system are enlarged, this results in a particularly secure lift or transport of the load. The effectiveness of the control can, in contrast, be increased by the blocking of individual mechanisms or the association of priorities to individual mechanisms.

It is equally possible to use those strategies in which specific parameters of the movement are automatically kept constant by the crane control. It is thus e.g. feasible to keep the alignment of the load constant during a lift or transport so that the crane operator only has to predetermine in which direction the load is to be moved. Alternatively, it is feasible to keep the position e.g. of the center of the load constant, while the crane operator presets a specific rotation of the load.

In the control system in accordance with the disclosure, a selection can advantageously be made between a presetting of a desired movement of the load and the presetting of a desired movement of the individual cranes, in particular from a single source. Each crane can thus in particular be controlled individually by the crane operator for the operating of the cranes above the load in order to position the crane above the load. It is then possible to switch into a different mode in which only the movement of the load is preset so that from now on the crane operator has to concentrate fully on the movement of the load and no longer on the control of the individual cranes.

The cranes are advantageously controlled such that once a distance is set between the suspension points of the load at the individual cranes, it is not changed during the load movement. The suspension points of the cranes thus only have to be correctly positioned once above the load, such as above a traverse, whereupon the crane control automatically takes care of the distance between the suspension points remaining constant during the movement of the load.

In a further advantageous manner, the cranes can be controlled such that once an alignment of the load is set, it is not changed during the load movement. The crane operator thus only has to preset the movement direction of the load.

The cranes can furthermore advantageously be controlled such that a desired alignment of the load is moved to during the load movement. In this connection, the crane operator presets the desired rotation of the load.

In a further advantageous manner, the position and/or the alignment of the load can be determined in the control system in accordance with the disclosure in that the position of the cranes is determined above the load. For this purpose, the crane operator only has to correctly position the cranes above the load, whereupon the control system in accordance with the disclosure knows on the pressing of a button how the load is aligned and how large it is. The absolute distance e.g. of the suspension points thus no longer has to be input by hand, but can be determined via the distance of the suspension points at the cranes.

The presetting of the desired movement is advantageously made online in the control system in accordance with the disclosure via an input device such as a joystick. The crane operator thus has control of the movement of the cranes or the load at all times.

In a further advantageous manner, the presetting of the desired movement can also take place offline via a crane deployment planner, e.g. by taking over a stored trajectory. The deployment can already be planned in advance at the crane deployment planner and can be stored in a corresponding file. The cranes can then be controlled during the actual deployment by taking over a trajectory from this file. The crane operator can, however, advantageously also intervene online via an input device for safety purposes.

With the control system in accordance with the disclosure, advantageously only those presettings of the desired movement are permitted which can be carried out by movement vectors which do not result in damage incidents in any of the cranes. A particularly comfortable operation is thus ensured since the crane operator can only preset those movements which do not result in damage incidents. The movements preset by him are thus not subsequently blocked, but he rather knows right from the start which movements can be carried out without damage incidents.

The present disclosure furthermore includes a control method for the lifting and/or transporting of a common load using a plurality of cranes, comprising the steps: presetting a desired movement of the load or of the cranes and determining possible damage incidents for movement vectors of the cranes, with the movement vectors used for the control of the cranes being limited to those movement vectors which do not result in damage incidents for any of the cranes. The control method in accordance with the disclosure has the same advantages as the control system described above.

The control method in accordance with the disclosure advantageously includes the features of the control systems or of the safety methods such as were described further above.

The present disclosure furthermore includes a control method for the lifting and/or transporting of a common load using a plurality of cranes, with the permitted movement vectors for the control of the cranes on the basis of a safety method in particular being determined in accordance with one of the safety methods described above. The same advantages can thus be achieved with this control method as with these safety methods.

BRIEF DESCRIPTION OF THE FIGURES

The present disclosure will now be described in more detail with reference to embodiments and drawings. There are shown.

DETAILED DESCRIPTION

In known methods, the lifting process or the transport of heavy and large loads using a plurality of cranes is carried out using a supervisor who coordinates all the crane operators involved. In this connection, each crane operator operates his own crane and also has only the safety systems of the respective crane at his disposal. However, a whole series of safety problems hereby result since, in such an operation, overloads can be caused by an uneven load distribution, by non-uniform lift movements of the cranes as well as in particular by an overload of a crane due to the movement of another crane. Furthermore, collisions of the cranes can result between one another, with the load and with buildings. Communication problems can also result between the supervisor and the crane operators, with the individual crane operator frequently no longer correctly gauging the situation. Influences on external systems moreover result due to the addition of the load torques of the individual cranes. With a plurality of cranes mounted on a ship, a non-permitted heeling of the ship can e.g. occur due to an addition of the load torques.

In the present embodiments of the disclosure, a safety strategy results for the avoidance of these risks which is in particular based on the taking into account of safety-relevant data of all cranes involved in the lift or transport. In a first step, the data of the individual cranes are collected and are thus available to the safety systems. For this purpose, use can be made of the measurement systems, e.g. for the load torque limitation and the drive control, already in place on the cranes. The data on the cranes then comprise the positions, speeds and accelerations of the individual crane drives or the positions, speeds and accelerations of the cranes or of the crane parts such as the boom. Data on the load can equally be determined.

Figure 1:
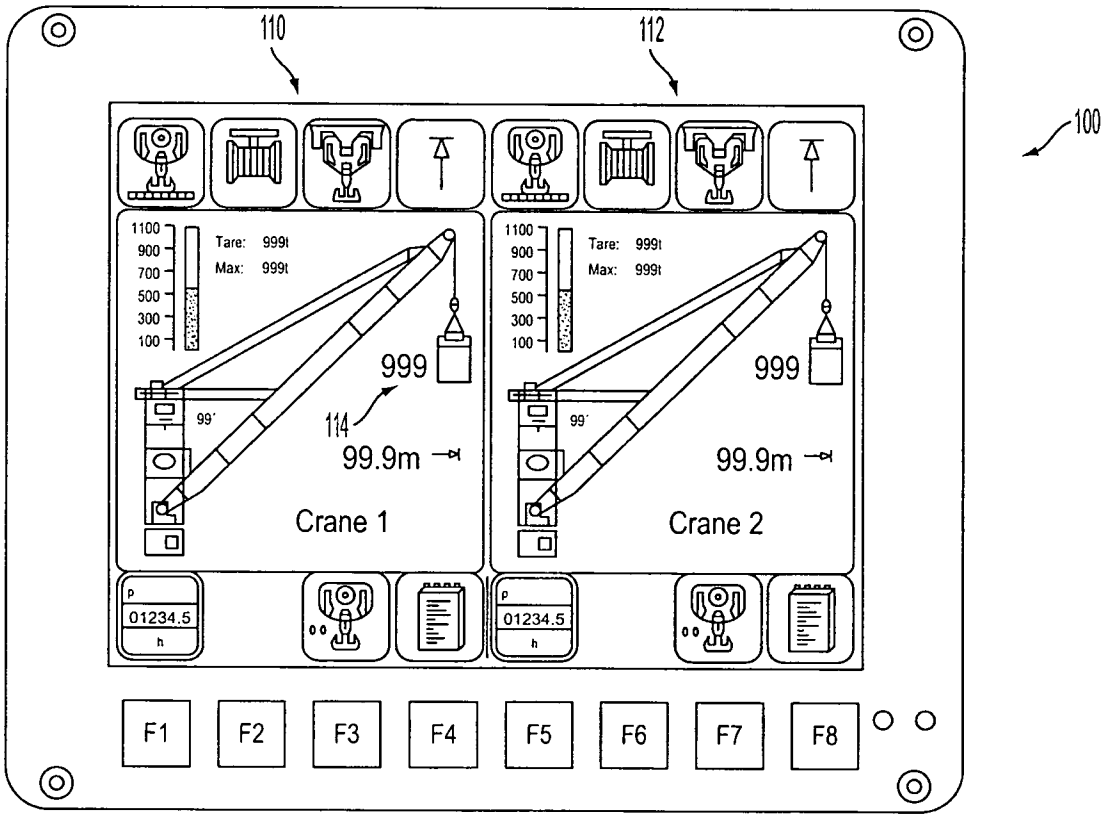
FIG. 1 shows the control panel of a safety system.

More relevant data for the crane operator such as the current position of the crane hooks in up to four dimensions (three axes and one rotation), the current speed of the crane hooks, likewise in four dimensions, the maximum possible current speeds of the crane hooks, the loads of the individual cranes, the degrees of capacity of the cranes, the torque sum of the cranes in two axes as well as the heeling of the cranes around two axes can then be determined from these data. As shown in FIG. 1, these data or a selection of these data can now be presented on any desired number of monitors so that the individual crane operators have a better overview of the total situation. Such a presentation of data of the other cranes involved, in particular all of the cranes involved, in a crane can naturally also be of great advantage independently of the safety systems in accordance with the disclosure. The crane operators can thus gage possible safety risks better and can react better to them. Specifically, FIG. 1 shows an example control panel display 100 having a first crane display 110 and a second crane display 112. Each display illustrates crane operating parameters, such as load 114, and various other data.

These safety risks can, however, also be evaluated by the safety system in accordance with the disclosure so that the display of the data on the monitor can also be dispensed with. The safety system in accordance with the disclosure can determine possible damage incidents for movement vectors of the cranes for this purpose. In the embodiment, such a movement vector represents a data set which describes the movement of all cranes. The movement vectors can either be preset by the crane operators themselves in that they actuate the control of the cranes. Alternatively, these movement vectors can, however, also represent possible movement vectors which are checked in a crane control as to whether they result in damage incidents.

If the movement vectors of the cranes are preset by the crane operators, the safety system of the present disclosure reacts to the recognition of a possible damage incident in that it activates at least one alarm function. This alarm function warns the driver against continuing with the intended movement. The safety system of the present disclosure has the great advantage that each crane operator is likewise automatically informed of possible damage incidents in all other cranes by the safety system. To increase safety, when a possible damage incident is recognized, it can also be automatically prevented in that either the movement of all cranes is stopped or a movement is at least limited to those directions which do not result in a damage incident.

The permitted movement vectors of the cranes which do not result in damage incidents in any of the cranes are determined in this connection by a predictive calculation in accordance with the present disclosure. Such a predictive calculation is in particular important to avoid the cranes being maneuvered into positions which they can no longer depart from without causing damage incidents at one of the cranes. The permitted movement vectors which do not result in such a situation are determined by an iterative method in this connection. It is thus e.g. first possible to check during such an iterative method whether a specific movement vector does not result in damage incidents in any of the cranes, whereupon it must still be checked whether, after control of the cranes using this movement vector, movement vectors are in turn possible which do not result in damage incidents in any of the cranes, and so on. The iterative method used can, however, also be necessary because the possible damage incidents of each individual crane depend on the total movement vector, i.e. on the movements of all cranes. A permitted vector can thus be determined in that the permitted vectors are first determined for one crane, whereupon they are checked for the next crane, and so on.

The security system in accordance with the disclosure can also be used in a control system. In this context, either all the cranes can be controlled by one single source for the presetting of the desired load movement or of the desired movement of the cranes. Alternatively, the system can, however, also only serve the monitoring and limiting of these movements with a separate presetting of each individual crane without a singular source.

The safety method of the present disclosure can now be used in such a crane control for a dynamic limitation of the movement vectors used for the control of the cranes. When checking which movement vectors result in damage incidents at the individual cranes, each crane limits the set of permitted vectors available. The set of movement vectors which is limited thereby and which cannot result in accident incidents in any of the cranes can then be used for the reliable control of the cranes. The influence factors which restrict the movement vectors in particular include an anti-collision control, the load torque limitation of the individual cranes as well as the taking into account of the limitation of external systems. These influence factors will now be described in more detail.

When determining whether specific movements result in a collision, the movement of all cranes involved is taken into account. This anti-collision check of the cranes is effected by a predictive calculation up to a possible standstill. In this connection, the predetermined dynamic properties of the cranes, in particular the possible speeds and accelerations of the crane drives are taken into account. It is therefore necessary to make a check for every movement of the cranes in the predictive calculation as to whether a prevention of the collision e.g. by a possible standstill is possible under the predetermined dynamic properties as well as while taking account of the other influence factors such as the load torque limitation. This predictive calculation makes it possible to move the cranes freely for as long as no collision is impending. In this connection, both collisions of the cranes among one another, with the load or with disturbance objects can be taken into account. A three-dimensional collision check can in particular be carried out. It is hereby possible also to secure complicated movement procedures which would no longer be possible with a two-dimensional collision check. Such a three-dimensional collision check is in particular important with complex loads so that possible collisions of the load with the cranes or with disturbance objects are also taken into account. For this purpose, a three-dimensional model of both the cranes and of the load and, optionally, of the disturbance objects is used in the safety system in accordance with the disclosure. In particular because the movement of the load also depends on the movement of all the cranes, three-dimensional models of all cranes and of the load can be used for an effective anti-collision check on the lift and/or transport of a common load using a plurality of cranes. In addition, any desired safety distance can be used as a protective zone around the objects to further increase the safety. This anti-collision device can also be active on the use of an individual crane.

It is furthermore determined whether movement vectors result in an overload of individual cranes. For this purpose, the load torque limit devices already present for the individual cranes can be used so that the overloads determined by the individual load torque limit devices for a movement vector limit the set of permitted movement vectors. In this connection, a predictive calculation is in turn used by an iterative process. In this context, either the already present load torque limit devices of the individual cranes can be made use of or these load torque limit devices can also be implemented in a central computer system. Movements which would result in a deactivation of the cranes due to the load torque limit devices can thus be prevented from the start.

Furthermore, limits of external systems such as the maximum permitted ground pressure, the heeling of a ship or the maximum permitted torque of a platform can be taken into account as damage incidents. The safety system in accordance with the disclosure thus provides for these systems also to be protected.

If all cranes are controlled centrally, only the desired load movement has to be preset by the crane operator. The presetting of the desired load movement or of the desired spatial position of the load can be generated either online, e.g. via a joystick, or offline via a path plan, e.g. by taking over the trajectories from a file of a crane deployment planner. The movement procedure of the load has six degrees of freedom, of which three correspond to the translations and three correspond to the rotations. The rotations can be input around any desired virtual point, with up to three directions actually being possible depending on the number of cranes and load holding means. The angular range of the rotational movement is normally geometrically and physically limited since the cranes cannot be moved over one another and can also not be tilted in any desired manner. The axis of rotation can, in contrast, be freely defined in the control system of the present disclosure.

A load direction which has e.g. been preset can usually be possible through a number of different movement vectors of the cranes of which none results in a damage incident. This is based on the fact that the cranes have a larger number of degrees of freedom e.g. via their luffing mechanism and their slewing gear and optionally their traveling gear. The safety and control system in accordance with the disclosure is in particular designed for luffing revolving cranes which are particularly well suited for the common lifting and transport of a load by a plurality of cranes. A plurality of predetermined strategies from which a selection can be made or which can be provided with priorities are now available for the selection of the movement vectors and so of the movement procedure which is used for the control of the cranes. It is possible e.g. to use as strategies those movement vectors for the cranes for which the actual values for the direction, speed and acceleration of the load differ as little as possible from the preset values. Equally, it can be used as a strategy to increase the safety distances from the anti-collision. Equally, individual mechanisms can be blocked or priorities can be associated with the individual mechanisms. Specific parameters of the load movement can also be kept constant so that the crane operator e.g. only presets the direction of the load movement or only a rotation.

Possible control modes will now be explained in more detail with reference to FIGS. 2 to 5. They show a tandem crane comprising two fixedly mounted revolving luffing cranes 210 and 212, which can be mounted on ships, such as ship 200. Both cranes have a slewing gear and a luffing mechanism for the respective booms (214 and 216) as well as a hoisting gear with which the rope length can be changed. The two cranes are used to lift or to transport a load 218 together, e.g. by means of a traverse 220.

Figure 2:
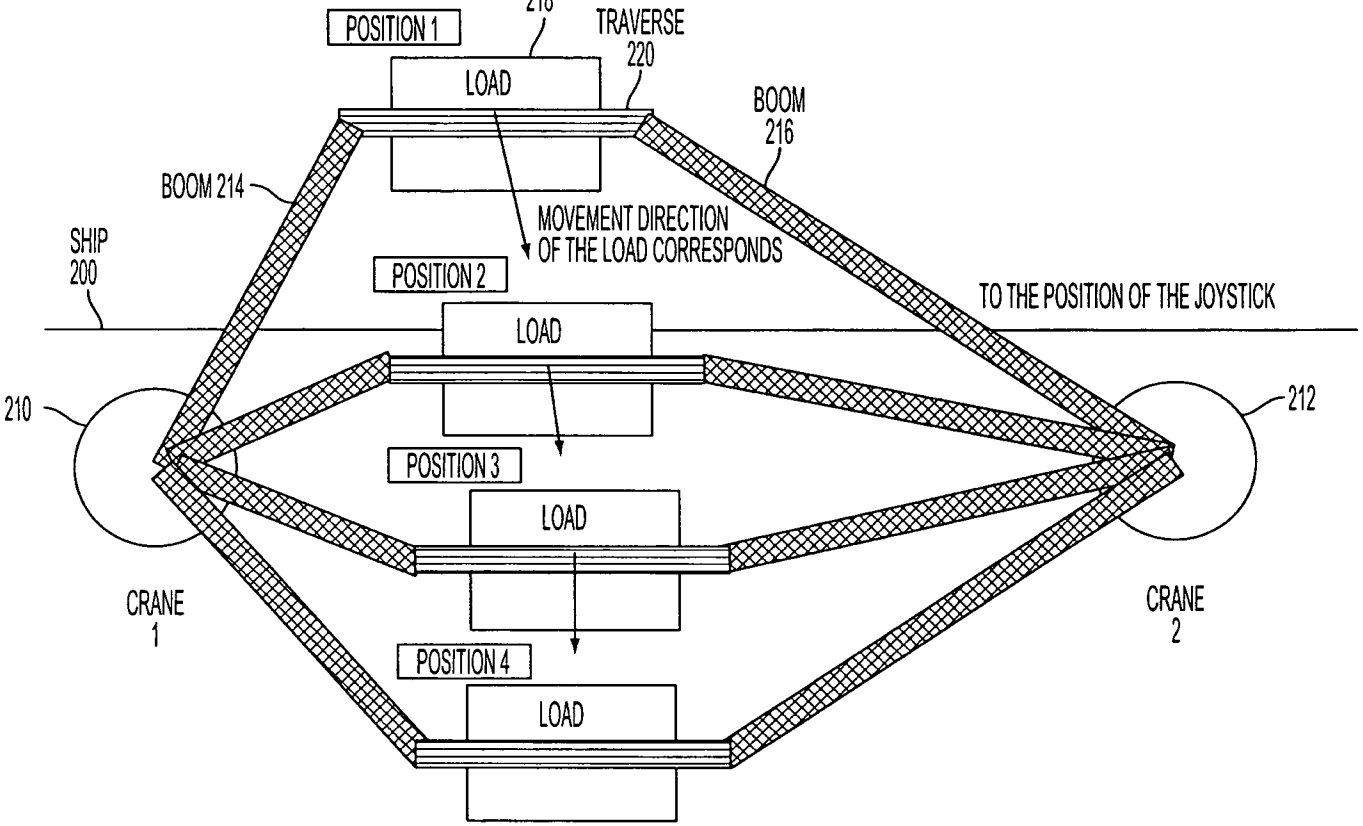
FIG. 2 shows the movement of a load using two cranes in accordance with the control system of the present disclosure.

On the parallel movement shown in FIG. 2, the movement direction for the load is preset online via the direction of the joystick, whereas the cranes are controlled such that the alignment of the load during the parallel movement is not changed. Now therefore to move along the direction preset by the joystick from position 1 to position 2, the booms of both cranes must be luffed up and the cranes revolved in opposite directions. In this connection, the luffing up of the booms and the revolving of the two cranes are coordinated with one another so that the load does not rotate. To avoid a tilting of the load, a matching has to be carried out in accordance with the rope length to keep the load in the horizontal. The reference point for the movement in this mode is either the tip of the boom of one's own crane or the load center.

Figure 3:
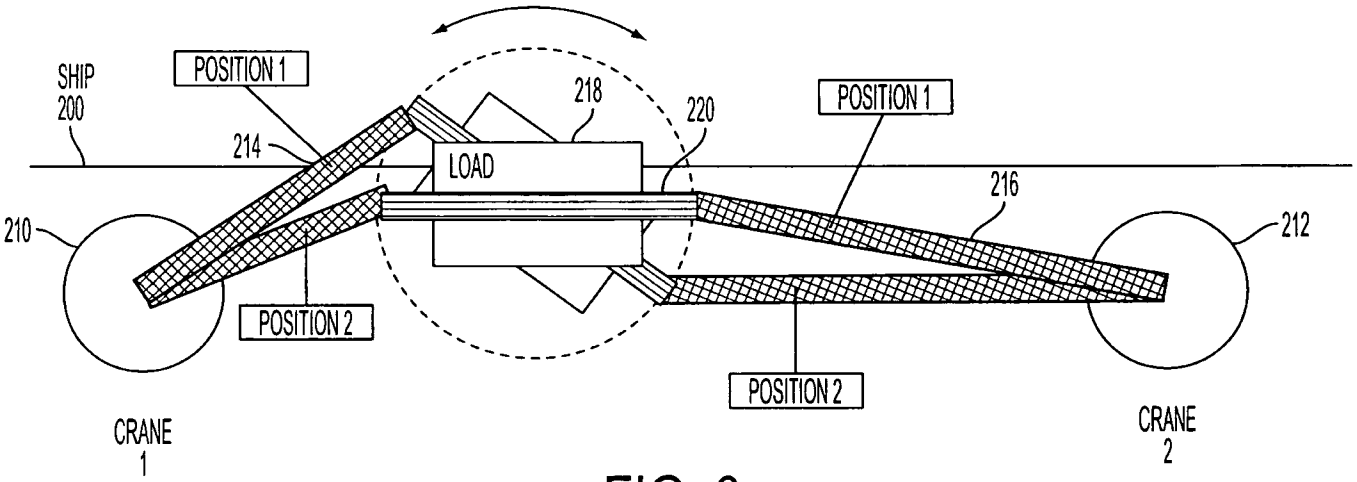
FIG. 3 shows the alignment of a load using two cranes in accordance with the control system of the present disclosure.

In FIG. 3, a rotational movement of the load is now shown in which the load is rotated around a vertical axis of rotation. To move the load 218 from position 1 to position 2, the boom of crane 1 has to be luffed up, as does the boom of crane 2. The rotary movement of the cranes, however, now takes place, in contrast to the mode shown in FIG. 2, in each case in the same direction, here clockwise both times. The position of e.g. the center of the load thereby does not change; however, the load is rotated. The rope lengths are adapted correspondingly to furthermore ensure a horizontal alignment of the load.

A combined movement of the tandem crane of a parallel movement and a rotary movement is equally possible. The load can thus be both moved and aligned.

To make the shown movements of the load possible, the maximum speeds and accelerations of the respective slewing gears and luffing mechanisms as well as the hoisting gears have to be taken into account in the control of the cranes. The desired direction is then maintained by the reduction of the speeds and accelerations in dependence on the limitation devices instantaneously active.

Limitations result in this connection from the demanded movement of the load, on the one hand, in particular in that the length between the suspension points of the traverse has to be kept constant. In addition, the protective system in accordance with the disclosure is used which includes a dynamic anti-collision device. This prevents the collision of the cranes with one another as well as a collision of the cranes with the load. A free movement is possible in this connection as long as no collision can occur. The control is thus based on a predictive calculation of the robot movement which takes account of the anti-collision distance and the dynamics of all cranes. The calculations can optionally be carried out in parallel in all cranes so that each crane carries out a braking maneuver on recognition of a collision.

If a future collision is recognized, the movement vectors used for the control of the cranes are limited in the corresponding direction to avoid a collision. A three-dimensional anti-collision check is carried out which is based on a corresponding three-dimensional geometrical model of the cranes and of the load, in particular because collisions of the load with the cranes should also be taken into account.

Figure 4:
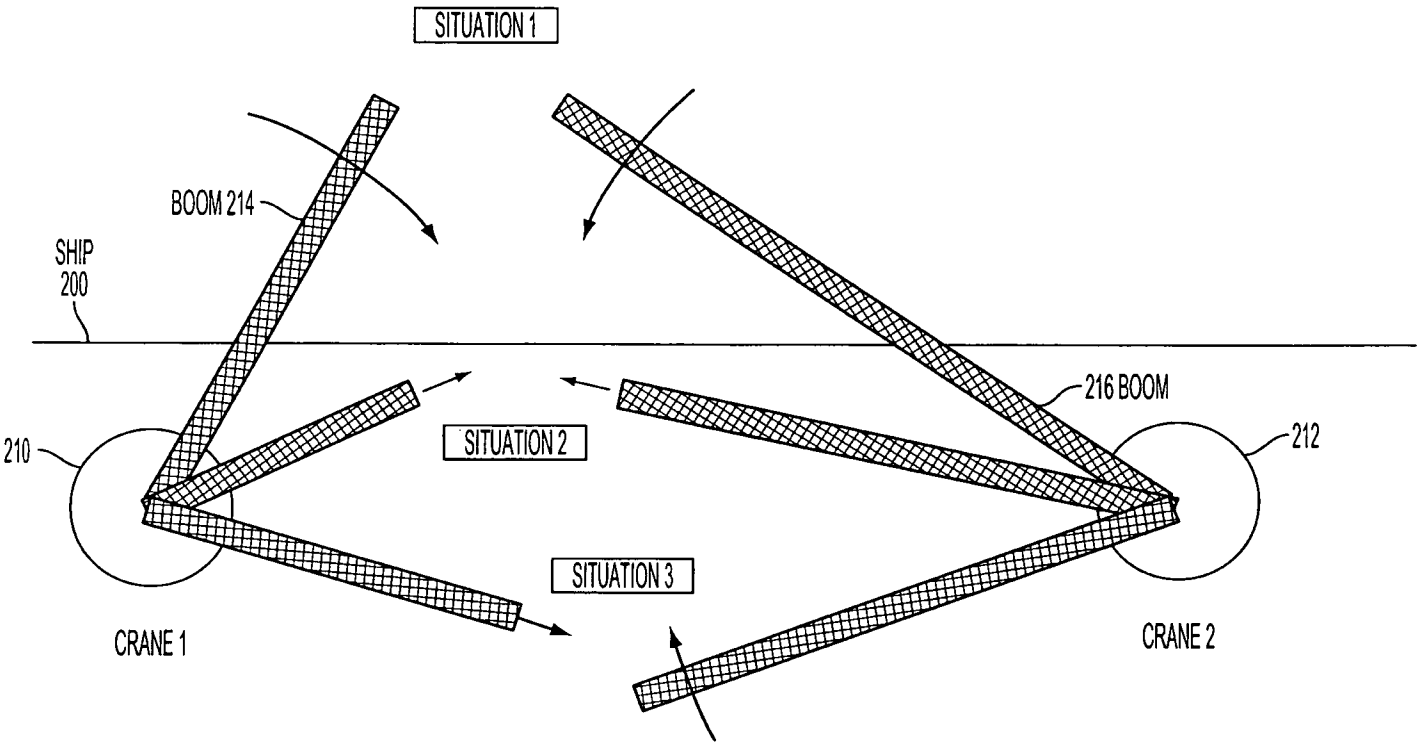
FIG. 4 shows the dynamic anti-collision procedure in accordance with the control method of the present disclosure.

This anti-collision system will now be described in more detail in FIG. 4, which shoes a first, second and third simulation of anti-collision. An anti-collision vector as well as intersection points for a future movement are calculated in this connection. If a future collision is recognized, the master switch signal or the movement vector of the cranes is limited in the direction of the expected collision. In this connection, the movement is, however, only braked in the direction which would result in a collision. The same integration times/ramps are used for the anti-collision as for normal operation.

Figure 5:
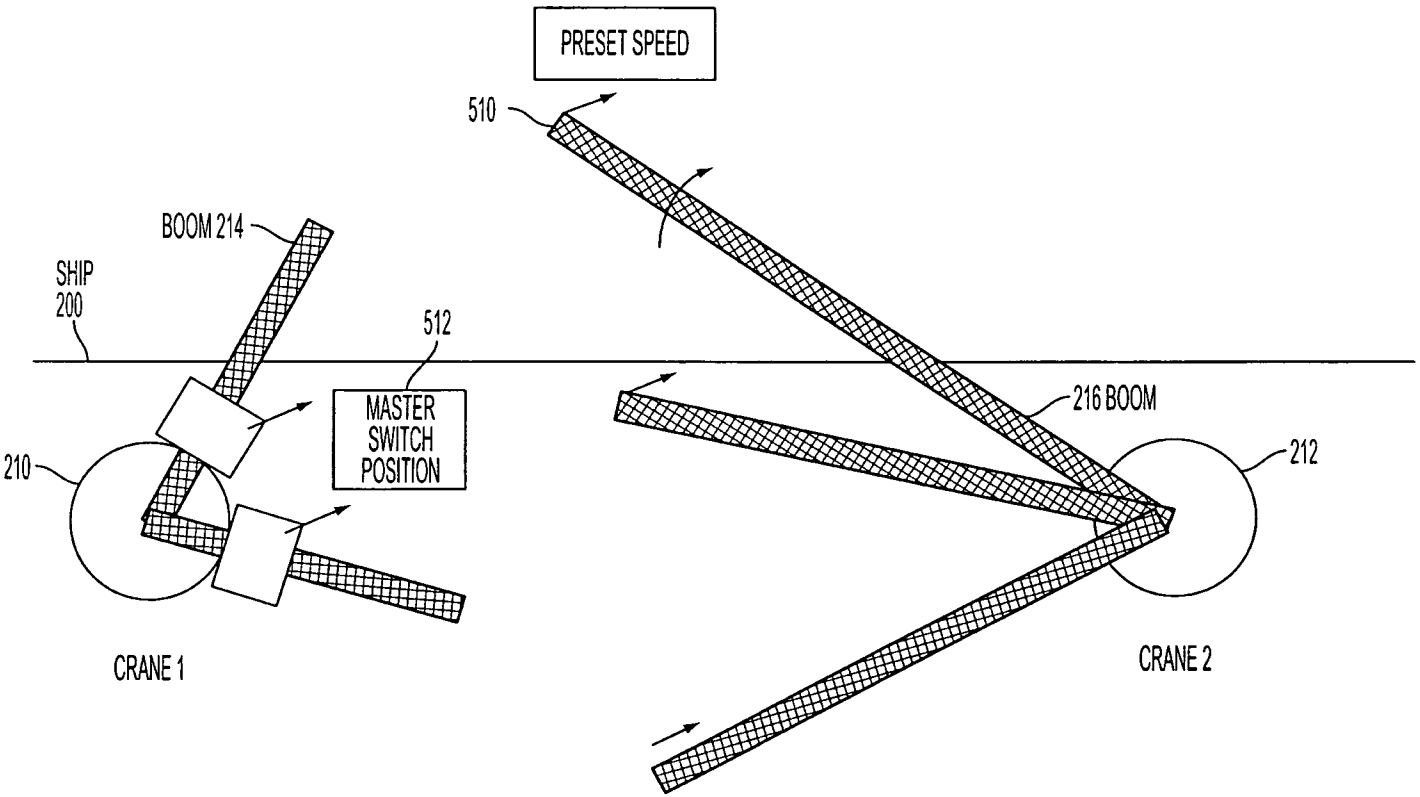
FIG. 5 shows the direct control of two cranes from a source in accordance with the control method of the present disclosure.

FIG. 5 now shows a mode in which crane 1 (210) or crane 2 (212) can be controlled separately, which is in particular used for the taking up of the load or for the positioning of the cranes above the load. In FIG. 5, crane 1 is controlled from the cabin of crane 1. Crane 2 is controlled in that the preset value for the movement of the crane tip of crane 2 510 is issued by the position of the master switch 512 in crane 1. The crane control translates this preset value into a corresponding control of the stewing gear and luffing mechanism of crane 2. The traverse length at the time of the preselection of the tandem operation can also be set via this separate control of the cranes. The cranes are moved into the corresponding positions above the traverse, whereupon the positions of the cranes can be determined and stored at the push of a button. The length and position of the traverse or the position and the dimensions of the load then result from these positions. No input of the absolute length is hereby necessary. The traverse length can in particular be determined automatically on the selection of tandem operation as the current spacing of the load pick-up points on the cranes. A correction can then take place in that the tandem operation is deselected, correction movements of the individual cranes are carried out and thereupon the tandem operation is again selected.

Figure 6C:
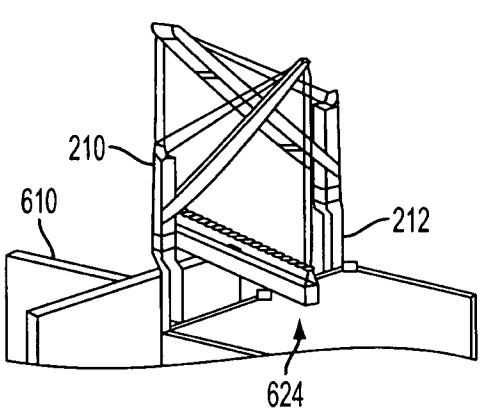
FIG. 6 shows the movement of a load using two ship cranes in accordance with the control system of the present disclosure.
Figure 6B:
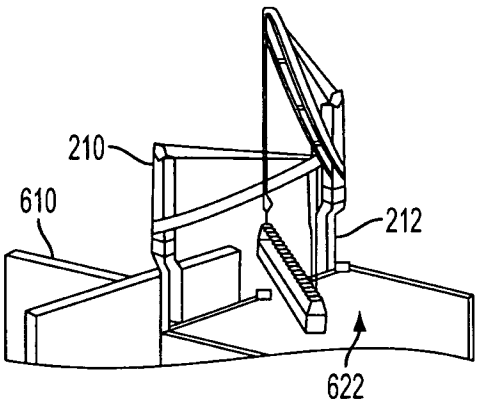
Figure 6A:
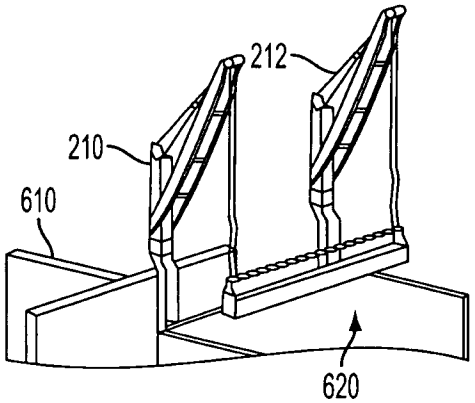

In addition, in the control system in accordance with the disclosure, the influencing of external systems by the cranes and vice versa can also be taken into account. If the cranes 210 and 212 are mounted on a heavy-load ship 610, as shown in FIG. 6, the total torque of the cranes influences the heeling of the ship. In particular, FIG. 6 shows the two cranes maneuvering a load at three positions (620, 622 and 624.) The safety system here can be configured either such that the heeling of the ship remains within specific limits. In addition, the ballasting device of the ship can be supplied with information or can be controlled immediately such that too strong a heeling is avoided in the interaction with the cranes. For this purpose, the total torque of the cranes can be determined around two axes as well as the center of gravity in three axes and the heeling of the cranes around two axes. After coordination, the ballasting points of the ship can be controlled in dependence on the travel speed and on the center of gravity, with the ship's crew additionally being able to intervene at any time. It is possible by this control of the ballasting device to permit larger torque sums of the cranes.

The safety or control system of the present disclosure can be connected to already present controls of the cranes and can co-use them. It can e.g. be connected to an onboard electronic CAN bus.

Use can be made of the sensor system already present on the crane for the provision of data for the alignment of the cranes and for the determination of data on the load. This sensor system is usually already present for purposes of overload security of the individual cranes and for the drive of the cranes. The transmission of these data can also take place by CAN bus. The display of the control can likewise take place via onboard standard monitors. The representation of any desired distances of the known objects is advantageously possible. It is equally possible to make use of the already present overload safety devices of the individual cranes, with each crane independently recognizing its overload and, additionally, also reacting to the overload recognition of the other cranes due to the safety system in accordance with the disclosure.

The invention claimed is:

1. A safety method for the lifting and/or transporting of a common load using a plurality of cranes, comprising the steps:

determining possible damage incidents for movement vectors of the cranes, wherein the movement vectors include at least speeds or accelerations of each of the plurality of cranes lifting and/or transporting the common load and represent a set of data which contains information on control of all cranes, and wherein permitted movement vectors are determined by a predictive calculation; and activating an alarm function if predetermined movement vectors result in damage incidents and/or limiting the movement vectors used for control of the cranes to those movement vectors which do not result in damage incidents in any of the cranes.

2. The safety method in accordance with claim 1, wherein the damage incidents include at least one overload of the cranes.

3. The safety method in accordance with claim 2, wherein a possible overload is determined via load torque limitations associated with respective cranes of the plurality of cranes.

4. The safety method in accordance with claim 1, wherein the determination of permitted movement vectors is based on an iterative method.

5. The safety method in accordance with claim 1, wherein the possible damage incidents include a collision of the cranes between one another.

6. The safety method in accordance with claim 5, wherein a calculation of the possible collisions is based on a geometrical model of the cranes, of the load and/or of the disturbance objects.

7. The safety method in accordance with claim 1, wherein the possible damage incidents include a collision of the cranes with the load.

8. The safety method in accordance with claim 7, wherein the determination of the collision is based on at least one geometrical model of the cranes and of the load.

9. The safety method in accordance with claim 8, wherein geometrical data of the load are input and/or determined.

10. The safety method in accordance with claim 9, wherein geometrical data of possible disturbance objects are input and possible collisions of the cranes and/or of the load with the disturbance objects are calculated.

11. The safety method in accordance with claim 1, wherein the possible damage incidents include exceeding limits of the torque sum of the cranes.

12. The safety method in accordance with claim 1, wherein the possible damage incidents include exceeding limits for external limitations including at least one of a maximum permitted heeling of a ship, a maximum permitted ground pressure and a maximum permitted torque of a platform.

13. The safety method in accordance with claim 1, wherein possible damage incidents are recognized in a predictive calculation, with their possible prevention being taken into account.

14. The safety method in accordance with claim 13, wherein the predictive calculations are carried out on the basis of dynamic properties of the cranes, including the maximum possible speeds and/or accelerations of crane drives.

15. The safety method in accordance with claim 1, wherein deformation of the cranes is taken into account.

16. The safety method in accordance with claim 1, wherein the alarm function includes an automatic deactivation of the cranes.

17. The safety method in accordance with claim 1, wherein safety distances from the possible damage incidents can be selected.

18. The safety method in accordance with claim 1, wherein data are forwarded to external systems including a ballasting control of a ship, to control them and/or to exchange data with the external systems.

19. The safety method in accordance with claim 1, wherein the cranes can be moved and have means for the determination of their positions, including GPS devices.

20. A control method for the lifting and/or transporting of a common load using a plurality of cranes, comprising the steps:

presetting a desired movement of the load or of the cranes; and determining possible damage incidents for movement vectors of the cranes, where determining possible damage incidents includes using a predictive calculation to check each movement vector to determine whether a current movement of that movement vector will directly result in a damage incident in any of the cranes and whether the current movement of that movement vector could provoke a future damage incident in any of the cranes, wherein the movement vectors used for the control of the cranes are limited to those movement vectors which do not directly result in damage incidents in any of the cranes and which could not provoke a future damage incident in any of the cranes, and where the movement vectors include at least speeds or accelerations of each of the plurality of cranes and represent a set of data which contains information on control of all cranes.

21. The control method in accordance with claim 20, wherein the movement vectors include permitted movement vectors for each of the cranes, the permitted movement vectors being those movement vectors in which a movement procedure is available which does not result in at least one damage incident.

* * * * *